US009139257B2

(12) United States Patent
Beriou

(10) Patent No.: US 9,139,257 B2
(45) Date of Patent: Sep. 22, 2015

(54) TWIN ARM GIN POLE

(71) Applicant: Thomas J. Beriou, Walker, MN (US)

(72) Inventor: Thomas J. Beriou, Walker, MN (US)

( * ) Notice: Subject to any disclaimer, the term of this patent is extended or adjusted under 35 U.S.C. 154(b) by 0 days.

(21) Appl. No.: 14/450,206

(22) Filed: Aug. 1, 2014

(65) Prior Publication Data

US 2015/0034000 A1 Feb. 5, 2015

Related U.S. Application Data

(60) Provisional application No. 61/861,208, filed on Aug. 1, 2013.

(51) Int. Cl.
*B63B 15/00* (2006.01)
*B63B 15/02* (2006.01)

(52) U.S. Cl.
CPC ..... *B63B 15/02* (2013.01); *B63B 2015/005* (2013.01)

(58) Field of Classification Search
USPC ..... 114/91
IPC ..... B63B 15/02,2015/0016, 2015/005
See application file for complete search history.

(56) References Cited

U.S. PATENT DOCUMENTS

| | | | | | |
|---|---|---|---|---|---|
| 2,740,537 | A * | 4/1956 | Johnston | 212/177 |
| 4,655,154 | A * | 4/1987 | Leonard | 114/91 |
| 5,083,520 | A * | 1/1992 | Bonnet | 114/91 |
| 5,134,950 | A * | 8/1992 | Berte | 114/39.27 |
| 5,509,368 | A * | 4/1996 | Wald | 114/39.21 |
| 5,529,007 | A * | 6/1996 | Fitzpatrick | 114/39.21 |
| 5,560,310 | A * | 10/1996 | Christensen et al. | 114/91 |
| 5,865,136 | A * | 2/1999 | Alexander | 114/91 |
| 6,116,177 | A * | 9/2000 | Conant | 114/91 |
| 2011/0232556 | A1* | 9/2011 | Fitch | 114/105 |
| 2013/0319311 | A1* | 12/2013 | Balfour | 114/91 |

* cited by examiner

*Primary Examiner* — Stephen Avila

(57) ABSTRACT

A twin arm gin pole is an apparatus that is used for leverage when raising or lowering a deck stepped mast on a sail boat. The apparatus includes a first arm, a second arm, a first lifeline stanchion coupler, a second lifeline stanchion coupler, a winch, and a halyard connector. The first arm and the second arm are connected in a V-shaped structural body. Each of the distal ends for the V-shaped structural body is hingedly connected to the boat by one of the lifeline stanchion coupler. The winch is connected adjacent to the vertex of the V-shaped structural body, and the halyard connector is connected adjacent to the V-shaped structural body, opposite the winch. The winch is cranked to either pull the V-shaped structural body towards or away from the deck of the boat. A halyard line is tethered between the halyard connector and the top of the mast.

18 Claims, 5 Drawing Sheets

TWIN ARM GIN POLE

The current application claims a priority to the U.S. Provisional Patent application Ser. No. 61/861,208 filed on Aug. 1, 2013.

FIELD OF THE INVENTION

The present invention relates generally to the field of boating equipment. More specifically, the present invention is an apparatus for a twin arm gin pole with winch.

BACKGROUND OF THE INVENTION

The trailer-able sailboats manufactured since the late 1960's are designed to have the deck stepped mast rather than the keel stepped mast still used on the larger boats. The deck stepped mast uses the tabernacle base to secure the mast to the deck. There is a compression post built into the boat between the deck and the keel. The tabernacle base allows the mast to be levered up into position rather than the need for a crane to set the mast.

The deck stepped mast with the tabernacle has become popular with the weekend sailor who is required to raise and lower the mast every time they use the boat. Usually short-handed or using a make-shift gin pole the effort involved in handling the mast discourages them from using the boat. The present invention will be a welcomed relief and allow them the sailing freedom they wished for. The present invention allows for one person to handle the winch while a second person keeps track of snags and attaches the final shackle. The objective of the present invention is to stabilize the mast while being raised and lowered preventing the typical sway of an ordinary gin pole or preventing the more dangerous side-to-side movement of a mast swing, both of which could threatens the mast and tabernacle base. The present invention will also eliminate the use of the main sheet block and tackle, which has a tendency to tangle and miss-align the rope feed.

DETAILED DESCRIPTION OF THE INVENTION

All illustrations of the drawings are for the purpose of describing selected versions of the present invention and are not intended to limit the scope of the present invention.

Figure 1:
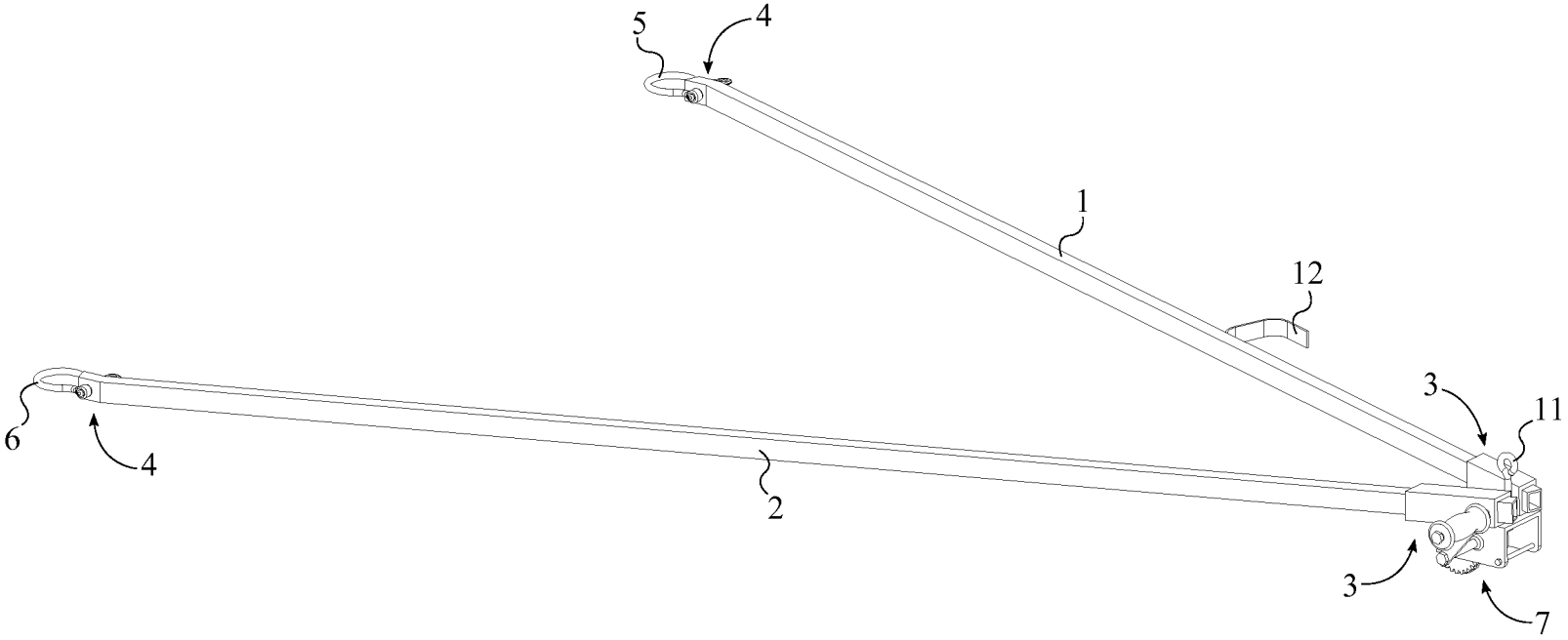
FIG. 1 is a perspective view of the present invention.
Figure 2:
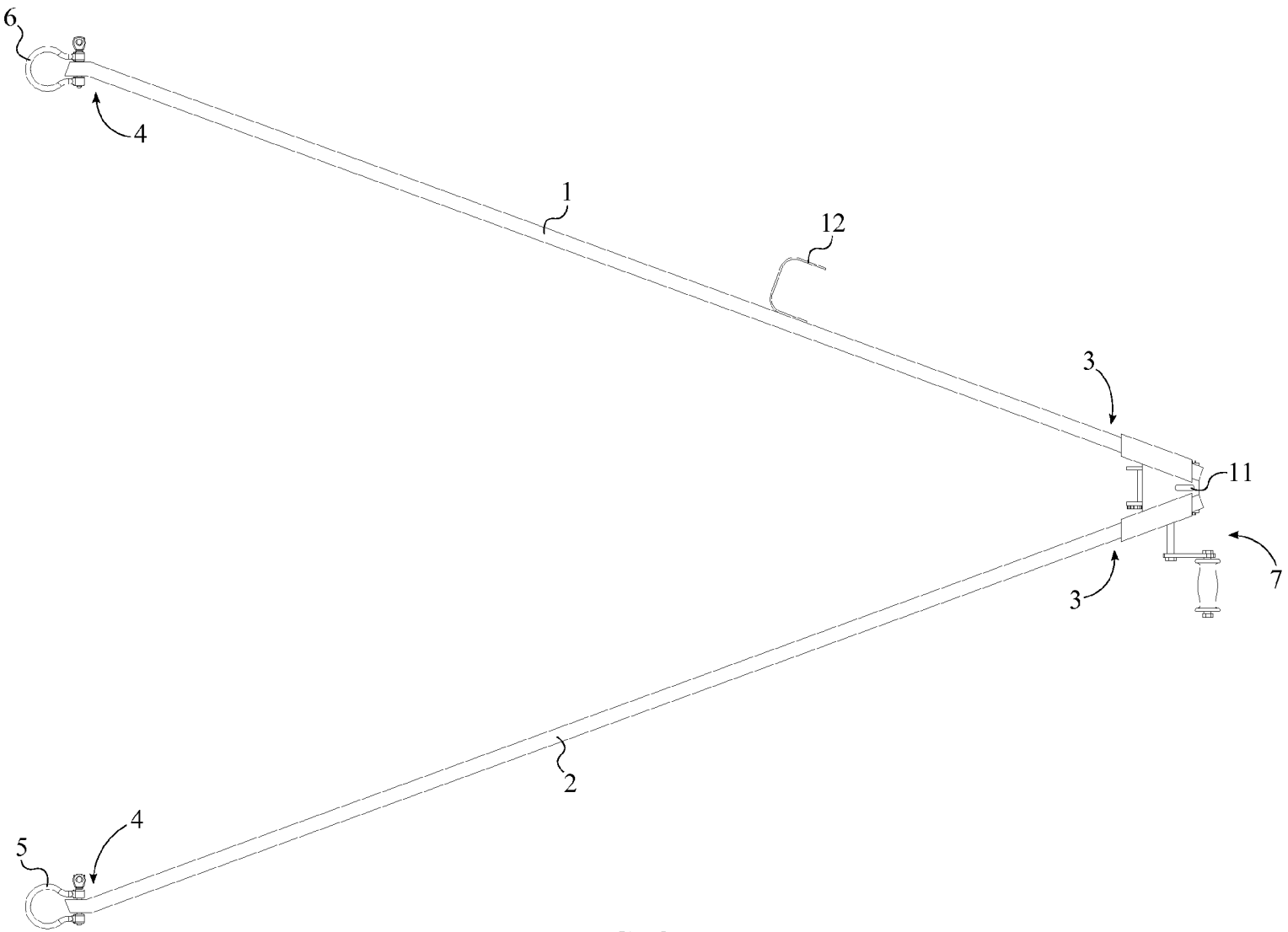
FIG. 2 is a top view of the present invention.
Figure 3:
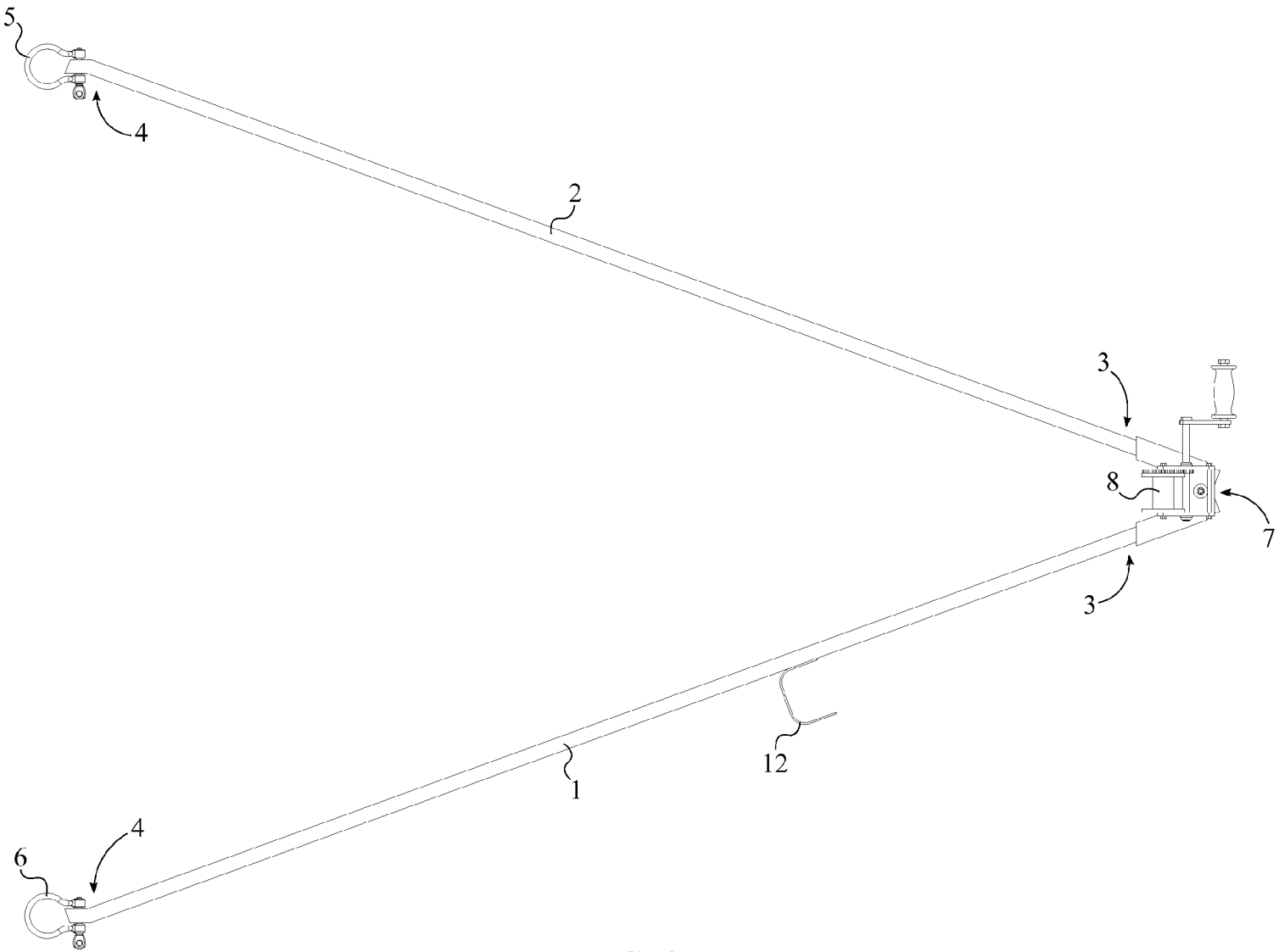
FIG. 3 is a bottom view of the present invention.

As can be seen in FIG. 1 through 3, the present invention is a twin arm gin pole that allows a user to more efficiently raise or lower a deck stepped mast 101 on a sail boat. The present invention mainly comprises a first arm 1, a second arm 2, a first lifeline stanchion coupler 5, a second lifeline stanchion coupler 6, a winch 7, and a halyard connector 11. The first arm 1 and the second arm 2 are two elongated bodies that are used for leverage when raising and lowering the deck stepped mast 101. The first lifeline stanchion coupler 5 and the second lifeline stanchion coupler 6 are designed to respectively attach the first arm 1 and the second arm 2 to the lifeline stanchion structure of the sail boat. The halyard connector 11 allows the present invention to be tethered to the top of the deck stepped mast 101 through a halyard line 100. The winch 7 is cranked in one direction by the user to raise the deck stepped mast 101 and is cranked in the other direction by the user to lower the deck stepped mast 101.

The general configuration of components allows the present invention simplifies the process of raising or lowering a deck stepped mast 101. The first arm 1 is orientated at an acute angle with the second arm 2, which creates a V-shaped structural body for the present invention. The first arm 1 and the second arm 2 each comprise a proximal end 3 and a distal end 4. The proximal end 3 of the first arm 1 is connected to the proximal end 3 of the second arm 2, which forms the vertex of the V-shaped structural body. The distal end 4 of the first arm 1 is adjacently and hingedly connected to the first lifeline stanchion coupler 5, which is mounted onto the lifeline stanchion structure. Similarly, the distal end 4 of the second arm 2 is adjacently and hingedly connected to the second lifeline stanchion structure, which is mounted onto the lifeline stanchion structure. The first lifeline stanchion coupler 5 and the second lifeline stanchion coupler 6 are positioned opposite to each other across the deck 102 of the sail boat. The winch 7 is adjacently connected to the distal end 4 of both the first arm 1 and the second arm 2, which allows the winch 7 to apply the maximum amount of torque on the first arm 1 and the second arm 2 as they respectively rotate about the hinged connections of the first lifeline stanchion coupler 5 and the second lifeline stanchion coupler 6. In addition, the halyard connector 11 is adjacently connected to the distal end 4 of the both the first arm 1 and the second arm 2, opposite to winch 7. Consequently, the first arm 1 and the second arm 2 can apply the maximum amount of torque on the deck stepped mast 101 through the halyard line 100 as the deck stepped mast 101 pivots about its other end.

In the preferred embodiment of the present invention, components with certain specifications are better suited to be used in the present invention. The first lifeline stanchion coupler 5 and the second lifeline stanchion coupler 6 are a pair of twisted D-shackles, each of which have a hinged connection with its respective arm through a stainless pin. The winch 7 is a 1500-pound brake winch, which locks in place when the winch 7 is not being cranked by a user in either direction. The first arm 1 and the second arm 2 are a pair of aluminum rectangular tubes, which allows the first arm 1 and the second arm 2 to be lightweight, easily maneuverable, and non-corrodible. Each aluminum rectangular tube is dimensioned at 1.5 inches by 1 inch by 7 feet. The halyard connector 11 is a stainless steel ring, which a simple coupling device for the halyard line 100.

Also in the preferred embodiment of the present invention, the winch 7 specifically comprises a crank axle 8, a strap 9, and a cleat coupler 10. The strap 9 is used to pull the first arm 1 and the second arm 2 in either a clockwise or counterclockwise direction. The strap 9 is wrapped and unraveled from the crank axle 8. The width of the strap 9 should be at 2 inches. The first end of the strap 9 is fixed to the crank axle 8, and the second end of the strap 9 is fixed to the cleat coupler 10, which is used to attach the strap 9 to an available cleat 104 with a backing plate on the deck 102. The cleat coupler 10 can be, but is not limited to, a hook.

A storage hook 12 is an ancillary component of the present invention that allows for a headstay or a fuller to be held by the present invention and allows for the headstay or the fuller to be guided into its proper position as the deck stepped mast 101 is raised or lowered. The storage is hook is laterally connected to either the first arm 1 or the second arm 2 in between the proximal end 3 and the distal end 4 of either the first arm 1 or the second arm 2. The storage hook 12 is designed to be coplanar to the first arm 1 and the second arm 2 so that the headstay or the fuller rests parallel to the deck 102 on the storage hook 12.

Figure 4:
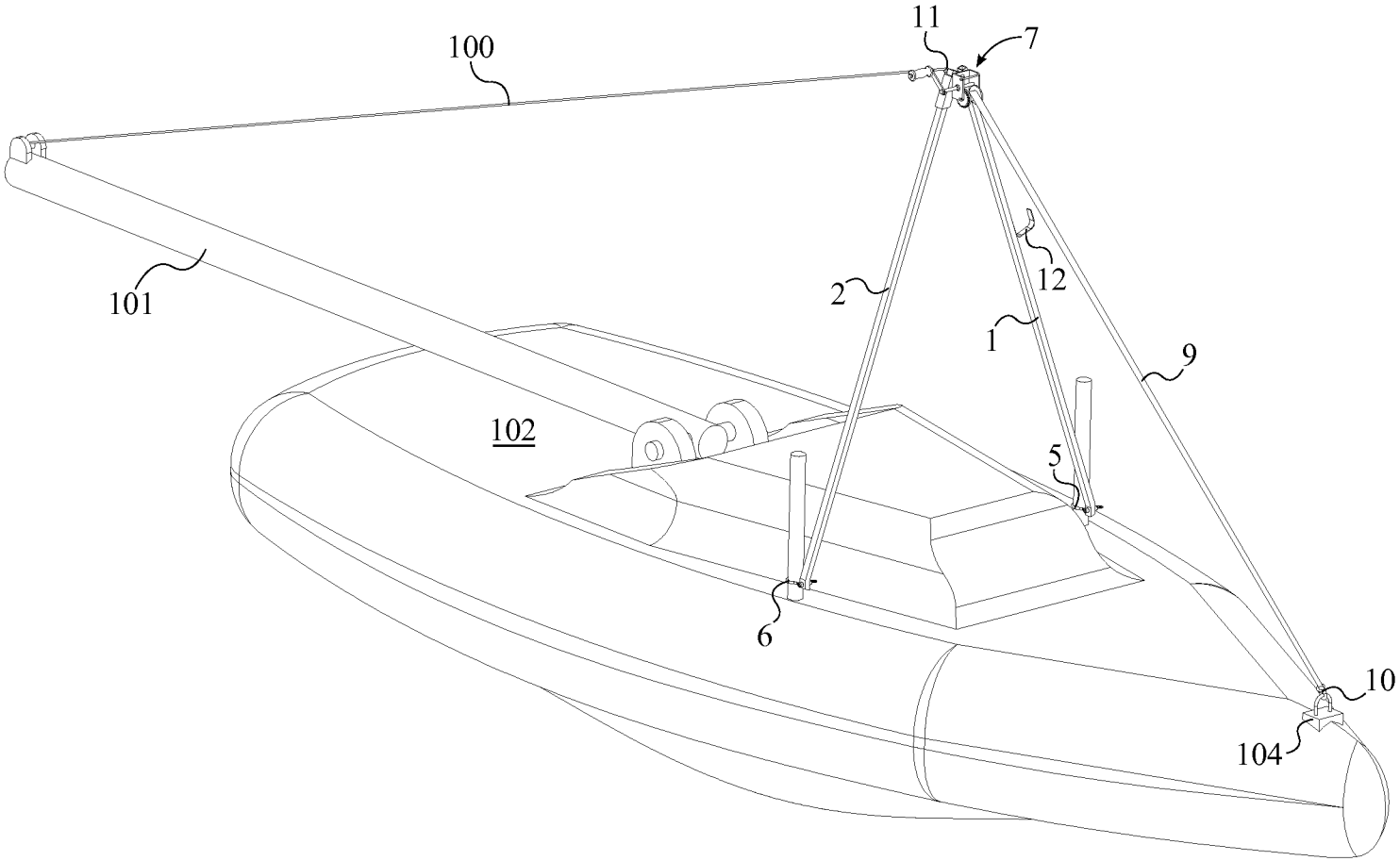
FIG. 4 is a perspective view of the present invention being attached to the lowered mast of a sail boat.
Figure 5:
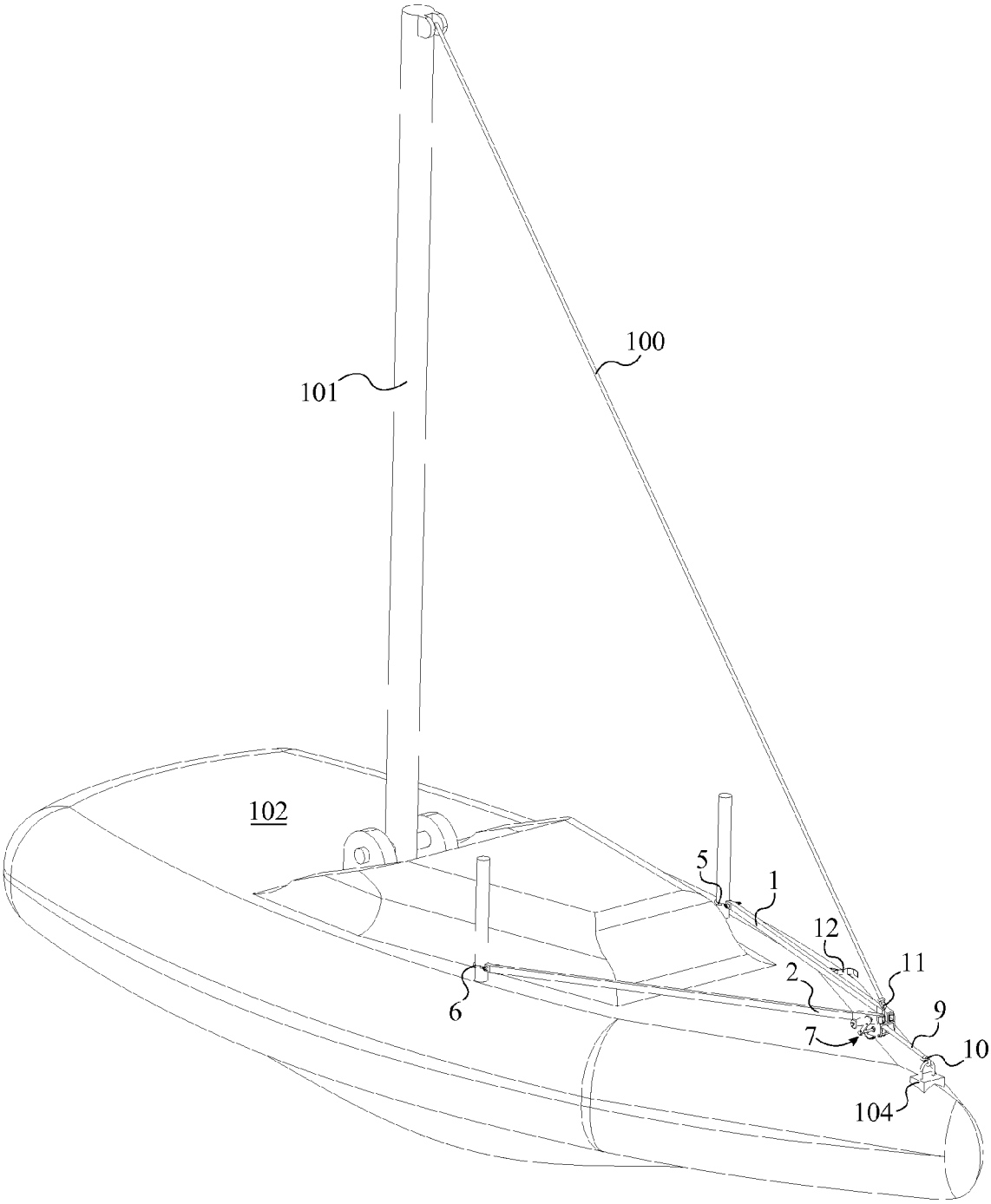
FIG. 5 is a perspective view of the present invention being attached to the raised mast of a sail boat.

The present invention is designed to complete two processes, which are shown in FIGS. 4 and 5. The first process is to raise the deck stepped mast 101 with the present invention. The first process begins with the V-shaped structural body of the first arm 1 and the second arm 2 being perpendicular to the deck 102 and begins with the deck stepped mast 101 being parallel to the deck 102. As the winch 7 is cranked by the user, the first arm 1 and the second arm 2 move towards the deck 102, and the deck stepped mast 101 moves away from the deck 102. The first process concludes with V-shaped structural body of the first arm 1 and the second arm 2 being parallel to the deck 102 and concludes with the deck stepped mast 101 being normal to the deck 102. In addition, the second process is used to lower the deck stepped mast 101 from its upright position. The second process begins with the V-shaped structural body of the first arm 1 and the second arm 2 being parallel to the deck 102 and begins with the deck stepped mast 101 being normal to the deck 102. As the winch 7 is cranked in reverse by the user, the first arm 1 and the second arm 2 move away from the deck 102, and the deck stepped mast 101 moves toward the deck 102. The second process concludes with V-shaped structural body of the first arm 1 and the second arm 2 being perpendicular to the deck 102 and concludes with the deck stepped mast 101 being parallel to the deck 102.

Although the invention has been explained in relation to its preferred embodiment, it is to be understood that many other possible modifications and variations can be made without departing from the spirit and scope of the invention as hereinafter claimed.

What is claimed is:

1. A twin arm gin pole comprises:
a first arm;
a second arm;
a first lifeline stanchion coupler;
a second lifeline stanchion coupler;
a winch;
a halyard connector;
said first arm and said second arm each comprise a proximal end and a distal end;
said first arm being oriented at an acute angle with said second arm;
said proximal end of first arm being connected to said proximal end of said second arm;
said distal end of said first arm being adjacently and hingedly connected to said first lifeline stanchion coupler;
said distal end of said second arm being adjacently and hingedly connected to said second lifeline stanchion coupler;
said winch being adjacently connected to said distal end of both said first arm and said second arm; and
said halyard connector being adjacently connected to said distal end of both said first arm and said second arm, opposite to said winch.

2. The twin arm gin pole as claimed in claim 1, wherein said first lifeline stanchion coupler and said second lifeline stanchion coupler are a pair of twisted D-shackles.

3. The twin arm gin pole as claimed in claim 1, wherein said winch is a 1500-pound brake winch.

4. The twin arm gin pole as claimed in claim 1, wherein said first arm and said second arm are a pair of aluminum rectangular tubes.

5. The twin arm gin pole as claimed in claim 1, wherein said halyard coupler is a stainless steel ring.

6. The twin arm gin pole as claimed in claim 1 comprises:
said winch comprises a crank axle, a strap, and a cleat coupler;
said strap being wrapped around said crank axle;
a first end of said strap being fixed to said crank axle; and
a second end of said strap being fixed to said cleat coupler.

7. The twin arm gin pole as claimed in claim 6, wherein said cleat coupler is a hook.

8. The twin arm gin pole as claimed in claim 1 comprises:
a storage hook;
said storage hook being laterally connected to said first arm;
said storage hook being positioned in between said proximal end and said distal end of said first arm; and
said storage hook being positioned coplanar with said first arm and said second arm.

9. The twin arm gin pole as claimed in claim 1 comprises:
a storage hook;
said storage hook being laterally connected to said second arm;
said storage hook being positioned in between said proximal end and said distal end of said second arm; and
said storage hook being positioned coplanar to said first arm and said second arm.

10. A twin arm gin pole comprises:
a first arm;
a second arm;
a first lifeline stanchion coupler;
a second lifeline stanchion coupler;
a winch;
a halyard connector;
said first arm and said second arm each comprise a proximal end and a distal end;
said first arm being oriented at an acute angle with said second arm;
said proximal end of first arm being connected to said proximal end of said second arm;
said distal end of said first arm being adjacently and hingedly connected to said first lifeline stanchion coupler;
said distal end of said second arm being adjacently and hingedly connected to said second lifeline stanchion coupler;
said winch being adjacently connected to said distal end of both said first arm and said second arm;
said halyard connector being adjacently connected to said distal end of both said first arm and said second arm, opposite to said winch;
said first lifeline stanchion coupler and said second lifeline stanchion coupler are a pair of twisted D-shackles; and
said winch is a 1500-pound brake winch.

11. The twin arm gin pole as claimed in claim 10 comprises:
said first arm and said second arm being a pair of aluminum rectangular tubes; and
said halyard coupler being a stainless steel ring.

12. The twin arm gin pole as claimed in claim 10 comprises:
said winch comprises a crank axle, a strap, and a cleat coupler;
said cleat coupler being a hook;
said strap being wrapped around said crank axle;
a first end of said strap being fixed to said crank axle; and
a second end of said strap being fixed to said cleat coupler.

13. The twin arm gin pole as claimed in claim 10 comprises:

a storage hook;

said storage hook being laterally connected to said first arm;

said storage hook being positioned in between said proximal end and said distal end of said first arm; and said storage hook being positioned coplanar with said first arm and said second arm.

14. The twin arm gin pole as claimed in claim 10 comprises:

a storage hook;

said storage hook being laterally connected to said second arm;

said storage hook being positioned in between said proximal end and said distal end of said second arm; and said storage hook being positioned coplanar to said first arm and said second arm.

15. A twin arm gin pole comprises:

a first arm;

a second arm;

a first lifeline stanchion coupler;

a second lifeline stanchion coupler;

a winch;

a halyard connector;

said first arm and said second arm each comprise a proximal end and a distal end;

said first arm being oriented at an acute angle with said second arm;

said proximal end of first arm being connected to said proximal end of said second arm;

said distal end of said first arm being adjacently and hingedly connected to said first lifeline stanchion coupler;

said distal end of said second arm being adjacently and hingedly connected to said second lifeline stanchion coupler;

said winch being adjacently connected to said distal end of both said first arm and said second arm;

said halyard connector being adjacently connected to said distal end of both said first arm and said second arm, opposite to said winch;

said first lifeline stanchion coupler and said second lifeline stanchion coupler are a pair of twisted D-shackles; and said winch is a 1500-pound brake winch;

said first arm and said second arm being a pair of aluminum rectangular tubes; and said halyard coupler being a stainless steel ring.

16. The twin arm gin pole as claimed in claim 15 comprises:

said winch comprises a crank axle, a strap, and a cleat coupler;

said cleat coupler being a hook;

said strap being wrapped around said crank axle;

a first end of said strap being fixed to said crank axle; and a second end of said strap being fixed to said cleat coupler.

17. The twin arm gin pole as claimed in claim 15 comprises:

a storage hook;

said storage hook being laterally connected to said first arm;

said storage hook being positioned in between said proximal end and said distal end of said first arm; and said storage hook being positioned coplanar with said first arm and said second arm.

18. The twin arm gin pole as claimed in claim 15 comprises:

a storage hook;

said storage hook being laterally connected to said second arm;

said storage hook being positioned in between said proximal end and said distal end of said second arm; and said storage hook being positioned coplanar to said first arm and said second arm.

* * * * *